United States Patent [19]

Staley et al.

[11] 4,431,467

[45] Feb. 14, 1984

[54] AGING PROCESS FOR 7000 SERIES ALUMINUM BASE ALLOYS

[75] Inventors: James T. Staley, Murrysville; Ralph R. Sawtell, Pittsburgh, both of Pa.

[73] Assignee: Aluminum Company of America, Pittsburgh, Pa.

[21] Appl. No.: 407,761

[22] Filed: Aug. 13, 1982

[51] Int. Cl.[3] ..... C22F 1/04

[52] U.S. Cl. ..... 148/159; 148/13.1; 148/417

[58] Field of Search ..... 148/159, 11.5 A, 12.7 A, 148/13.1, 158, 417

[56] References Cited

U.S. PATENT DOCUMENTS

| | | | |
|---|---|---|---|
| 3,198,676 | 8/1965 | Sprowls | 148/159 |
| 3,284,193 | 11/1966 | Anderson et al. | 75/141 |
| 3,469,433 | 9/1969 | Fresch et al. | 72/364 |
| 3,706,606 | 12/1972 | DiRusso et al. | 148/12.7 |
| 3,791,876 | 2/1974 | Kroger | 148/417 |

OTHER PUBLICATIONS

*Metals Handbook, 9th Edition,* vol. 4, pp. 682–683, 700–703, Nov. 1981, American Society for Metals, Metals Park, Ohio.

*Primary Examiner*—M. J. Andrews
*Assistant Examiner*—S. Kastler
*Attorney, Agent, or Firm*—Andrew Alexander

[57] ABSTRACT

Aluminum base 7000 series alloys can have improved tensile properties when, after heat treatment and subsequent quenching, they are subjected to a three-step aging process comprising a first aging step at 190°–230° F., a second aging step at over 230° F. and a third aging step at 315°–380° F. The improved process is particularly effective in improving the tensile properties of slowly quenched materials such as large extrusions or forgings.

11 Claims, 2 Drawing Figures

AGING PROCESS FOR 7000 SERIES ALUMINUM BASE ALLOYS

BACKGROUND OF THE INVENTION

This invention relates to thermal treatments of aluminum base alloys. More particularly, the invention relates to an improved aging process for an aluminum base alloy containing zinc, magnesium and copper as the alloying constituents.

Aluminum base alloys, particularly 7000 series alloys containing zinc, magnesium and copper, are conventionally solution heat treated at a temperature of from 750°-1000° F. The alloy is then quenched by exposure to cool air, hot water or cold water to retain a substantial portion of the dissolved components in a state of solid solution. The rate of quenching is influenced by several factors, including the possible inducement of residual stresses as well as the overall physical dimensions of the article to be quenched. Certain physical properties, particularly the tensile properties are dependent on the rate of quench. More particularly, the slower quench rates which may be necessary to avoid inducement of residual stresses or which may be necessary due to the physical bulk of the article, can significantly lower the tensile properties of the resultant article.

Conventionally, aluminum articles which have been heat treated and quenched are subsequently subjected to an aging process to enhance certain physical properties, including tensile properties. While aging, in its most simplified and traditional form, might simply involve allowing the material to remain at ambient temperature for a significant period of time prior to use, the more common and economically efficient practice today involves artificial aging. In an artificial aging practice, the heat treated and quenched material is maintained at an elevated temperature with respect to room temperature to accelerate the aging. For example, the aging temperature may range from 150°-350° F. The article is maintained at this temperature for a period of time of perhaps 4 to 24 hours and then allowed to cool to room temperature.

Some time ago, employees of the assignee of the present invention determined that significant improvements in certain physical properties, such as resistance to stress corrosion, cracking and tearing, could be improved if subsequent to the solution heat treatment and quenching the aging was carried out in two distinct steps at two different temperatures. Thus, in Sprowls et al, U.S. Pat. No. 3,198,676, assigned to the assignee of this invention, a two-step aging process is disclosed wherein the article is first aged at a temperature of from 175° to 275° F. for a period of from 3 to 30 hours (depending on the amount of zinc) followed by a subsequent aging step within the range of 315° to 380° F. for a period of from 2 to 100 hours. While the patentees disclosed a rather broad temperature range (175° to 275° F.) for the first step, in actual practice the patentees only illustrated aging carried out in the first step at a temperature range of from 225° to 270° F.

While the practice of the process disclosed in the aforementioned patent does result in enhanced properties, the overall tensile properties are still undesirably low for aluminum alloys which have been quenched at a slow rate.

SUMMARY OF THE INVENTION

It is, therefore, an object of the invention to provide an improved process for the aging of aluminum base alloys containing zinc, magnesium and copper.

It is another object of the invention to provide an improved aging process wherein aluminum base alloy articles previously subjected to solution heat treatment and subsequent quenching are artificially aged in a three-step aging process.

It is yet a further object of the invention to provide an improved aging process wherein aluminum base alloy articles are aged in a three-step aging process wherein the temperature at which the article is aged is increased with each subsequent aging step.

These and other objects of the invention will be apparent from the subsequent description and accompanying drawings.

DESCRIPTION OF THE INVENTION

Figure 1:
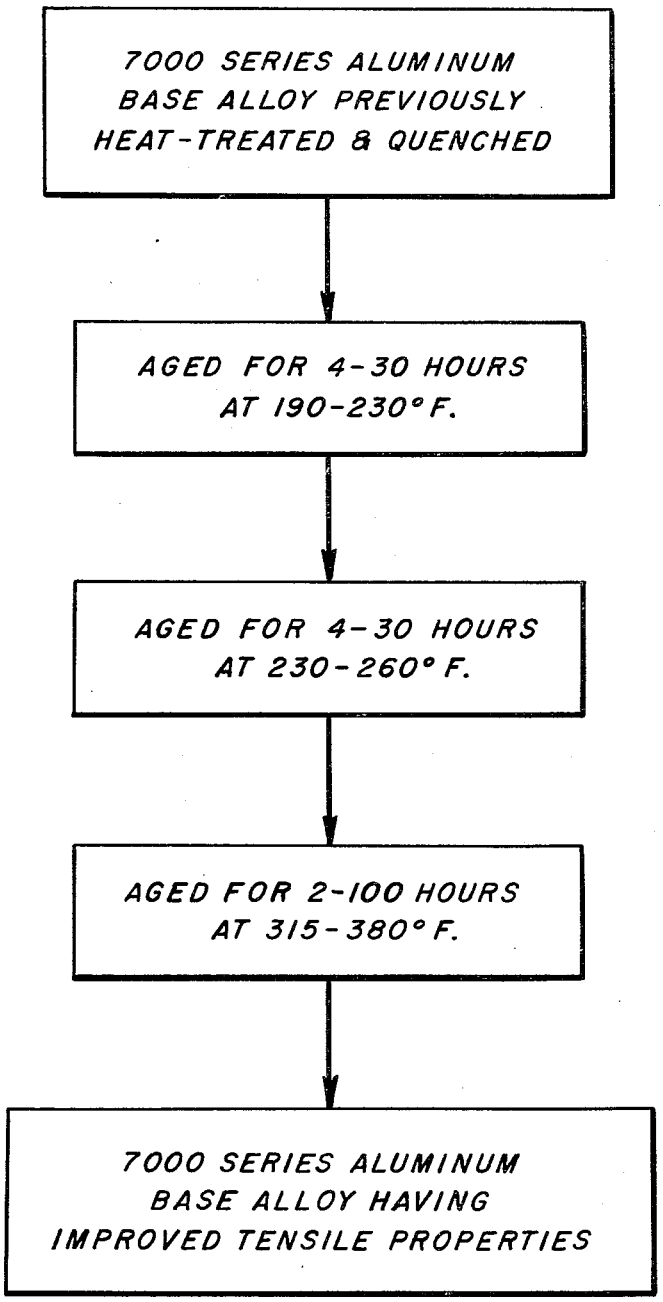
FIG. 1 is a flow sheet illustrating the process of the invention.

In accordance with the invention, an aluminum base alloy containing alloying amounts of zinc, magnesium and copper is aged in a three-step process subsequent to solution heat treatment and quenching.

The aluminum base alloy, generally known as 7000 series alloy, consists essentially of aluminum, 1.5 to 14 wt.% zinc, 0.8 to 3.8 wt.% magnesium, 0.25 to 2.6 wt.% copper and at least one additional alloying element selected from the group consisting of 0.05 to 0.4 wt.% chromium, 0.1 to 0.75 wt.% manganese, 0.05 to 0.3 wt.% zirconium, 0.05 to 0.3 wt.% vanadium, 0.05 to 0.3 wt.% molybdenum and 0.05 to 0.3 wt.% tungsten, the ratio of magnesium to zinc being 0.2 to 0.5 parts by weight magnesium per part by weight of zinc.

The aluminum base alloy is fabricated into an article of desired shape which may be a forging, extrusion or plate. The aluminum base alloy article is then subjected to a solution heat treatment which involves heating to a temperatures within the range of 750° to 1000° F., but below the range of incipient fusion and then holding the article at that range for a length of time sufficient to obtain substantially complete solution of the zinc, magnesium and copper components. Generally, this can be accomplished with a period of from 3 or 4 minutes up to 10 hours, depending on the thickness of the article and whether the surface of the article is directly exposed to the heating medium. Thus, an article having a thickness of ½ inch can be treated in a shorter time in an air atmosphere than one which has a thickness of 2 inches.

At the conclusion of the heat treatment, the article is rapidly cooled to substantially room temperature by quenching. The quenching may comprise contacting the article with cold water, hot water or with air, depending upon the desired rate of quench. It should be noted here that while rapid quenching is desirable to achieve certain physical properties, the mass of the article may prevent the use of very rapid quenching because of the inducement of residual stresses thereby.

The heat treated and quenched article is then subjected to aging in accordance with the invention. The first stage of aging consists of heating the aluminum base alloy article to a temperature of from 190° to 230° F., preferably 195° to 205° F. Upon reaching this temperature, the article is maintained at this temperature for from 4 to 30 hours, preferably at least 8 hours. The temperature is then raised for the second aging step to a temperature of from over 230° to 260° F., preferably 245° to 255° F. The article is then maintained at this temperature for an additional 4 to 30 hours, preferably 8 hours. Finally, the temperature is raised from 315° to 380° F., preferably 335° to 350° F., for the third aging step. The article is held at this temperature for from 2 to 100 hours, preferably 8 hours, but longer if needed, to achieve T7 temper conditions.

To further illustrate the invention, a number of samples were prepared using a 7075 alloy. The samples were solution heat treated for 30 minutes in a circulating air furnace at 880° F. The samples were then quenched at varying rates in water or air according to the following table.

TABLE 1

| Sample | Quench Media | Quench Rate °C./sec | (°F./sec) |
|---|---|---|---|
| I | Water at 21° C. (70° F.) | 1089 | (1960) |
| II | Water at 77° C. (170° F.) | 370 | (666) |
| III | Water at 99° C. (210° F.) | 39.1 | (70.3) |
| IV | Air Blast | 8.22 | (14.8) |
| V | Still Air | 1.9 | (3.42) |

The quenched samples were then aged using, respectively, two-step aging in accordance with the prior art and three-step aging in accordance with the invention. For each quench rate, four samples were aged. Samples A(I-V) were aged for 8 hours at 200° F. followed by a second aging step for 8 hours at 340° C. Samples B(I-V) were aged for 8 hours at 200° F. in a first step; 8 hours at 250° F. in a second step; and 8 hours at 340° F. in a third step. Samples C(I-V) were aged at 225° F. for 8 hours in a first step and 8 hours at 340° F. in a second step. Samples D(I-V) were aged for 8 hours at 225° F. in a first step; 8 hours at 250° F. in a second step; and 8 hours at 340° F. in a third aging step. The three-step aging process to which each of the B and D series samples were treated is representative of the novel process of the invention while the two step process used for the A and C series samples is representative of the prior art as taught by the aforementioned Sprowls et al patent.

Figure 2:
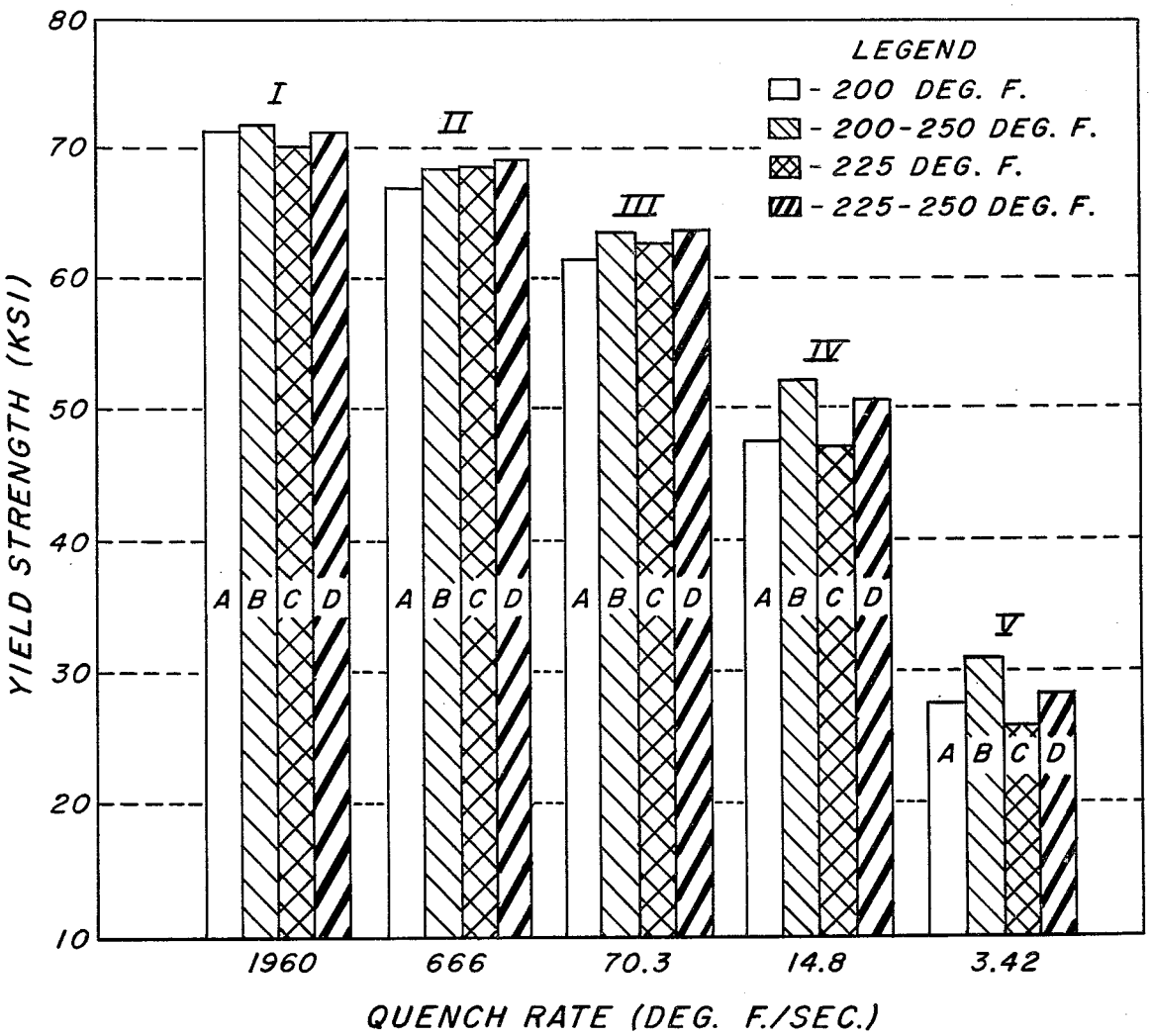
FIG. 2 is a graph illustrating the practice of the invention at two different first step temperatures versus prior art two-step processes at various quench rates.

Turning to FIG. 2, the resulting yield strengths (KSI) are plotted for the various samples. In each instance, the samples subjected to the three-step aging process of the invention resulted in a higher yield strength although the results are more marked at the lower quench rates. In addition, it is noted that at the lower quench rates (Samples IVB, IVD, VB and VD), the samples quenched using a lower first step temperature (200° F. instead of 225° F.) resulted in a higher yield strength than when the higher temperature was used in the first step.

Thus, it can be seen that the invention, although useful at all quench rates, is particularly effective at lower quench rates and, thus, will find its greatest usefulness in the aging of larger and more massive forgings, extrusions or plate which cannot be subjected to rapid quenching.

While the inventors do not wish to be bound by any theory of operation for the aging process of the invention, it has been proposed that the success of the invention is related to the favorable effect of the process on the precipitates distribution in the material quenched at low rates. It appears that the temperature at which GP zones (first precipitates formed after quenching) dissolve upon reheating decreases with decreasing quenching rate. Thus, the amount of dissolution of the GP zones upon subsequent heating to a given first step aging temperature will be dependent upon the quench rate to which the aged sample was subjected.

Furthermore, the use of a low temperature first aging temperature appears to foster the growth of the GP zones which, in turn, raises the critical reversion temperature at which the precipitates may redissolve. This critical reversion temperature apparently is very high in rapidly quenched articles and, therefore, is not exceeded in subsequent aging. However, if it is exceeded by the aging temperature in more slowly quenched products, the GP zones formed during natural aging would revert, and some or all of the remaining solute would precipitate directly in a form to which the GP zones are gradually transformed during growth, thereby resulting in a coarser distribution resulting in additional losses of maximum attainable strength.

In any event, however, by the practice of the invention, the deleterious effects of slower quench rates, regardless of their possible cause and effect on nucleation and precipitation, can be effectively reduced.

Having thus described the invention, what is claimed is:

1. An improved aging process for an aluminum base alloy containing alloying amounts of zinc, magnesium and copper which has been heat treated and quenched which consists essentially of:
   (a) heating the alloy to a temperature of from 190° to 230° F. and maintaining the alloy at this temperature for a period of at least 4 hours in a first aging step;
   (b) raising the temperature of said aged alloy of step a to from over 230° to 260° F. and maintaining the alloy at this temperature for a period of at least 4 hours in a second aging step; and
   (c) raising the temperature of said aged alloy of step b to from 315° to 380° F. and maintaining the alloy at this temperature for at least 2 hours in a third aging step.

2. The process of claim 1 wherein the alloy is maintained at the temperature at each aging step for at least 8 hours.

3. The process of claim 1 wherein the temperature of the first aging step is 195° to 205° F.

4. The process of claim 1 wherein the temperature of the second aging step is from 245° to 255° F.

5. The process of claim 1 wherein the aluminum base alloy comprises a 7000 series alloy containing from 1.5 to 14 wt.% zinc, 0.8 to 3.8 wt.% magnesium and 0.25 to 2.6 wt.% copper.

6. The process of claim 5 wherein said 7000 series aluminum base alloy further contains at least one additional alloying element selected from the group consisting of 0.05 to 0.4 wt.% chromium, 0.1 to 0.75 wt.% manganese, 0.05 to 0.3 wt.% zirconium, 0.05 to 0.3 wt.% vanadium, 0.05 to 0.3 wt.% molybdenum and 0.05 to 0.3 wt.% tungsten.

7. The process of claim 6 wherein the ratio of magnesium to zinc is 0.2 to 0.5 parts by weight magnesium per part by weight zinc.

8. The process of claim 1 wherein the aluminum base alloy comprises a 7000 series alloy containing 5.1 to 6.1 wt.% zinc, 2.1 to 2.9 wt.% magnesium and 1.2 to 2.0 wt.% copper.

9. The process of claim 8 wherein the alloy is aged for about 8 hours at 200° F. followed by aging for about another 8 hours at 250° F. and finally aged for about 8 hours at 340° F.

10. A three step aging process which is particularly effective to increase the tensile strength of a slowly quenched aluminum base alloy containing 1.5 to 14 wt.% zinc, 0.8 to 3.8 wt.% magnesium, 0.25 to 2.6 wt.% copper, and at least one additional alloying element selected from the group consisting of 0.05 to 0.4 wt.% chromium, 0.1 to 0.75 wt.% manganese, 0.05 to 0.3 wt.% zirconium, 0.05 to 0.3 wt.% vanadium, 0.05 to 0.3 wt.% molybdenum, and 0.05 to 0.3 wt.% tungsten and a ratio of 0.2 to 0.5 parts by weight magnesium per part by weight of zinc, said aging process consisting essentially of:

(a) heating the alloy to a temperature of from 190° to 230° F. and maintaining the alloy at this temperature for a period of at least 4 hours in a first aging step;

(b) raising the temperature of said aged alloy of step a to from over 230° to 260° F. and maintaining the alloy at this temperature for a period of at least 4 hours in a second aging step; and (c) raising the temperature of said aged alloy of step b to from 315° to 380° F. and maintaining the alloy at this temperature for at least 2 hours in a third aging step.

11. The process of claim 10 wherein said alloy is quenched, prior to said aging, at a rate not exceeding 39.1° C. per second whereby the tensile strength of the resultant alloy may be increased without increasing the quench rate to avoid inducement of residual stresses in the resultant article.

* * * * *